United States Patent [19]

Howell, Jr.

[11] 4,201,230

[45] May 6, 1980

[54] BONG WITH FULL-BORE REMOVABLE PLUG STANDARD

[76] Inventor: Joseph R. Howell, Jr., 20 Ford Ave., Boonsboro, Md. 21713

[21] Appl. No.: 958,936

[22] Filed: Nov. 6, 1978

[51] Int. Cl.[2] ..... A24F 1/30

[52] U.S. Cl. ..... 131/173; 131/257; 248/188.9; 248/359.1

[58] Field of Search ..... 131/173, 257, 225, 257; 248/188.9, 188.8, 359.1; 215/228, 100 R, 277, 279

[56] References Cited

U.S. PATENT DOCUMENTS

| | | | |
|---|---|---|---|
| 852,242 | 4/1907 | Redlich | 215/228 |
| 2,513,193 | 6/1950 | Miller | 248/188.9 X |
| 4,031,904 | 6/1977 | Karl | 131/173 |
| 4,101,044 | 7/1978 | Paquette et al. | 215/228 |

*Primary Examiner*—Stephen C. Pellegrino

*Attorney, Agent, or Firm*—Cushman, Darby & Cushman

[57] ABSTRACT

The base of a bong-type smoking pipe is provided with a full bore radially expansible/contractile, rotably actuated plug-type closure that incorporates a standard for supporting the pipe in a generally upright condition. Upon removal of the plug and the smoking bowl unit, the full bore of the main tube is accessible for cleaning, e.g. with a bottle brush or in an automatic dishwasher.

6 Claims, 3 Drawing Figures

BONG WITH FULL-BORE REMOVABLE PLUG STANDARD

BACKGROUND OF THE INVENTION

Bong-type smoking devices, i.e. water pipes are shown in the following prior U.S. patents.

| Patentee | Patent No. | Issue Date |
|---|---|---|
| McFadden et al | 3,881,499 | May 6, 1975 |
| Frost | 3,882,875 | May 13, 1975 |
| Heggesteun | 4,044,781 | August 30, 1977 |

These pipes have in common a reservoir partly filled with liquid, having a smoking-material bowl unit communicated via a tube to below the liquid level, a smoke-drawing tube communicated to the head-space of the reservoir, above the liquid level, and a need to be periodically cleaned in order to prevent souring of the reservoir and interior walls of the pipe with ash, residue and whatever the liquid removes from the gas stream.

In order to permit cleaning, various approaches have been tried. In McFadden et al there are several internal chambers, including one that is accessible by removal of a plug shown in FIG. 10 thereof and the others are made to have removable plugs or caps to facilitate cleaning.

Outside the smoking pipe art, the prior U.S. patent No. 3,365,093, of Malenke, issued Jan. 23, 1968 is for a neoprene plug which may be expanded into sealing engagement with a smooth-walled circular aperture in the wall of an internal combustion engine water jacket by the head of a bolt embedded in the plug and cooperating with a washer engaging a boss on the water jacket wall. The bolt shank extends through the outer face of the plug and threadably receives a nut thereon, engaging the washer.

SUMMARY OF THE INVENTION

The base of a bong-type smoking pipe is provided with a full bore radially expansible/contractile, rotably actuated plug-type closure that incorporates a standard for supporting the pipe in a generally upright condition. Upon removal of the plug and the smoking bowl unit, the full bore of the main tube is accessible for cleaning, e.g. with a bottle brush or in an automatic dishwasher.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT OF THE INVENTION

The pipe 10 includes a generally upright main tube 12 having a smooth longitudinal bore 14. At its lower end, the main tube 12 removably accommodates a base unit 16 which both closes off the lower end of the bore 14 and acts as a standard so that the pipe may be supported thereon in a generally upright condition. That permits the main tube to be filled part-way up with a cooling and filtering liquid, such as water W, e.g. to a level L.

Figure 1:
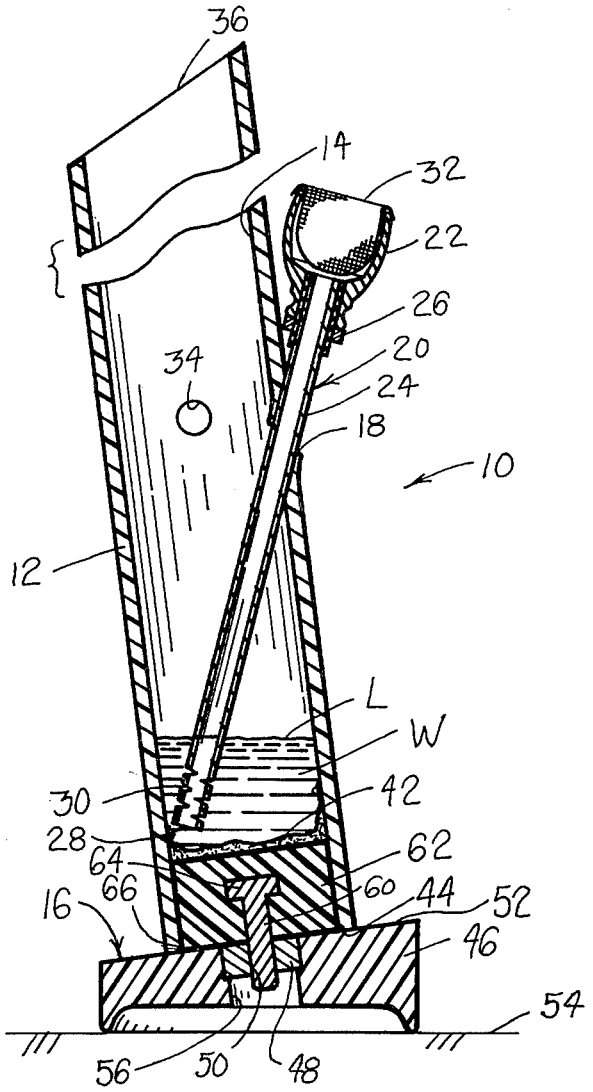
FIG. 1 is a longitudinal sectional view of a bong-type smoking pipe provided with a full bore radially expansible/contractile rotably actuated plug-type base closure that incorporates a standard for supporting the pipe in a generally upright condition.
Figure 3:
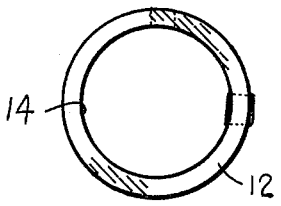
FIG. 3 is a bottom plan view of the main tube, disassembled from the remainder for cleaning.

Intermediate its height, the main tube 12 has an opening 18 provided therethrough on a slant. This opening removably, snuggly slidingly recieves a smoking bowl unit 20. The latter typically includes a smoking bowl 22 having an auxiliary tube 24 removably fitted in its bottom center, e.g. via disassemblable fastening means 26. The lower end 28 of the auxiliary tube 24 may be open and/or there may be a number of small openings 30 provided through the tube 24 near its lower end. At the top, the tube 24 communicates with the interior of the smoking bowl 22. A thimble-like, removable, wire gauge screen 32 is mounted in the smoking bowl. When the smoking bowl unit is in place as shown in FIG. 1, the lower end 28 of the auxiliary tube 24 lies below the water level L.

Numeral 34 designates a finger hole through the sidewall of the main tube 12 above the water level L.

Preferably the main tube is of constant, circular transverse cross-sectional figure and is cut-off on a slant at the upper end 36, but squarely at the lower end 44.

The pipe 10 is smoked in the normal manner: Smoking mixture is placed in the bowl 22, upon the screen 32 and lit. The smoker places the upper end 36 of the main tube against hits or her face, perimetrically surrounding their mouth and pneumatically draws upon the main tube. The smoking mixture coals then burn more briskly as air is drawn down through them and the combustion gas stream travels down the auxiliary tube, bubbles out at 28, 30 and passes up through the cooling and filtering liquid W, into the headspace 38 and into the smoker. In the course of this smoking procedure, some fine ash is drawn through the screen and is wetted and left behind in the reservoir liquid W. Also, some of the smoke constituents which are water-soluble are left behind in the reservoir liquid as the combustion gases bubble up into the headspace.

These left-behind constituents can be fairly described as smelly, cruddy, gummy, muddy and even yuckky, especially when the reservoir liquid is not changed frequently and/or the pipe is left to stand overnight or between smokings with fouled liquid in its reservoir. This characteristic the pipe of the invention shares in common with the bongs of the prior art. However, the pipe of the invention is easily cleaned, not only of the fouled liquid, but also of such pitchlike deposits as have stuck onto the interior walls of the reservoir (i.e. onto the bore wall 40 and onto the top surface 42 of the base unit 16.

The base unit 16 is shown including a radially enlarged, generally circular base 46 having a nut 48 embedded therein coaxially therewith so as to have the internally threaded bore 50 of the nut accessible through the upper face 52 of the base 46. Preferably, the base 46 is somewhat wedge-shaped as seen in longitudinal cross-section, i.e. its upper face 52 is disposed at an acute angle to the plane on which its bottom face 54 rests.

The base 46 must be open at 56 below the bore of the nut to accommodate the shank 58 of the bolt 60.

The top surface 42 of the base unit 16 is provided on a resilient, e.g. neoprene plug 62 which has the head 64 of the bolt 60 non-rotatively embedded therein. A thin washer 66, e.g. of lubricous material such as polyethylene sheet is received on the bolt shank 58 between the nut 48 and the bottom end surface 68 of the plug 62.

Figure 2:
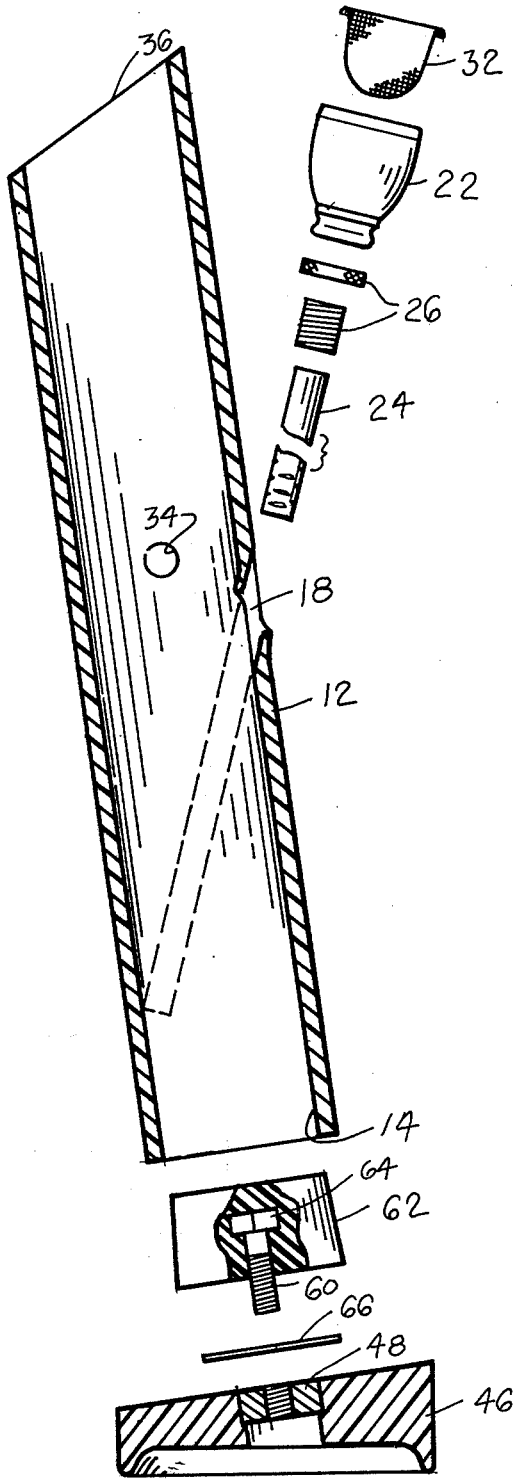
FIG. 2 is an exploded longitudinal sectional view thereof showing disassembly for cleaning.

When the plug 62 is in the condition shown in FIG. 2, it is somewhat axially longer but radially smaller than when it is in the condition shown in FIG. 1. Thus, from the FIG. 2 disposition, the plug may be installed merely by pushing it into the lower end of the main tube until its lower end surface 68 is flush with the lower end of the main tube. Then, the washer 66 may be installed thereon and the base via its nut 48 threaded onto the downwardly protruding bolt shank.

The base 46 is then rotated by hand, just as if it were the handwheel of a household heating system hot water radiator, until it is tight. In this step what has just happened is that the nut, has pulled the shank axially downwards slightly relative to the resilient body of the plug, causing the plug material to become axially squeezed between the bolt head and the nut-base upper surface at the site of the washer 66. The slight radial expansion of the plug sealingly secures it as a closure for the bottom end of the main tube.

When the pipe is to be cleaned, the reservoir liquid is dumped out and the smoking bowl unit is withdrawn for cleaning. Next, the handwheel-like base 46 is rotated in an unscrewing sense. This allows the resilient plug to recover its smaller-diameter figure so it can be axially withdrawn from the lower end of the bore of the main tube.

Now, the main tube has been reduced to being substantially just a tubular cylinder with a couple of holes through its sidewall, and has a full bore fully open at both ends. This points up not only how easily the main tube may now be cleaned, but also how easy it is to manufacture in the first place. Note there is no non-stock condition at the lower end of the main tube, e.g. no threading or the like on the tube stock needed to permit full bore access through the lower end.

At this point the main tube may be cleaned using a bottle brush, just like cleaning a rifle barrel, and/or the whole business may be simply put in the dishwasher; that goes for the shanked plug 62 also. Accordingly, these parts are easily cleaned.

The diameter of the plug 62 should be such that, even in the FIG. 2 condition it needs to be softly force fit into the main tube bore lower end. That is so it will not turn as the base 46 is being turned to activate the plug. Accordingly, it is preferred that when the plug is being installed and removed, the nut of the relatively large handwheel-like base 46 not be entirely threadably disengaged from the shank of the bolt. Rather, it is preferably merely loosened sufficiently to take the axial loading off the lower end face of the plug. Accordingly, the relatively large diameter handwheel-like base is available to be cocked back and forth by hand to help remove or install the plug from and in the main tube bore lower end.

In the best mode presently contemplated by the inventor, the smoking bowl unit is made of metal, the main tube of acrylic plastic and the base unit is fabricated as follows: The nut of a hole plugging unit of Malenke U.S. Pat. No. 3,365,093 is simply deposited in the bottom of a soft drink can from which the top has been removed. The can is rested on a shim so that it is tilted slightly from the vertical. Some R.T.V. or setting plastic resin is poured into the can, embedding the nut. The plastic is allowed to cure or set and the composite nut/plastic resin body is removed from the can and any excess plastic removed from obstructing the nut bore. This composite is threaded to the remainder of a Malenke plugging unit to provide the base unit of the pipe of the present invention.

Of course the base 46 may be made of other materials such as wood, metal or other plastics and the nut may be embedded therein by other means than molding-in-place. For instance it may be secured by an adhesive in a socket milled in a metal base or force fit in a non-circular socket formed in a wooden base.

It should now be apparent that the bong with full-bore removable plug standard as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A bong-type smoking pipe, which includes:

a generally upright main tube with a longitudinal bore open at the upper and lower ends thereof, an auxiliary tube surmounted by a smoking bowl, the main tube having a sidewall through which said auxiliary tube extends so as to have an inner, lower end disposed within the main tube below a notional cooling and filtering liquid level; and a base unit, including:

a handwheel member having an internally threaded socket opening through one face thereof and having an opposite face which provides a support surface for standingly supporting the pipe; and a generally cylindrical plug having a bolt with the head thereof embedded nonrotatively therein and on externally threaded shank thereof projecting therefrom;

said plug being removably force fit in the lower end of said main tube bore, said handwheel internally threaded socket threadably receiving said bolt shank and said handwheel being tightened axially compressing and radially expanding the plug to simultaneously removably plug the lower end of said main tube bore and provide a standard for the pipe.

2. The bong-type smoking pipe of claim 1, wherein:

the handwheel is a generally cylindrical plastic molding having a nut coaxially embedded therein to provide said internally threaded socket.

3. The bong-type smoking pipe of claim 1, further including:

a washer for lubricous plastic material disposed about said shank between said plug and said handwheel member.

4. The bong-type smoking pipe of claim 1, wherein:

said handwheel is substantially larger in diameter than said main tube.

5. The bong-type smoking pipe of claim 4, wherein:

said handwheel has two axially opposite faces which are disposed at a small acute angle to one another.

6. The bong-type smoking pipe of claim 1, wherein: said main tube is provided with an opening obliquely therethrough above said notional level, said auxiliary tube being slidably received through said oblique opening, so that when said auxiliary tube is withdrawn and said base unit is removed, the remaining main tube is essentially full-bore tubular with both ends open for ease of cleaning.

* * * * *